US005901557A

United States Patent [19]

Grayson

[11] Patent Number: 5,901,557

[45] Date of Patent: May 11, 1999

[54] PASSIVE LOW GRAVITY CRYOGENIC STORAGE VESSEL

[75] Inventor: Gary D. Grayson, Huntington Beach, Calif.

[73] Assignee: McDonnell Douglas Corporation, St. Louis, Mo.

[21] Appl. No.: 08/943,401

[22] Filed: Oct. 3, 1997

Related U.S. Application Data

[60] Provisional application No. 60/027,624, Oct. 4, 1996.

[51] Int. Cl.[6] ..... F17C 3/10; F17C 7/02

[52] U.S. Cl. ..... 62/45.1; 62/50.1; 62/50.7; 62/48.3

[58] Field of Search ..... 62/45.1, 48.3, 62/48.1, 50.1, 50.7

[56] References Cited

U.S. PATENT DOCUMENTS

| | | | |
|---|---|---|---|
| 3,001,376 | 9/1961 | Webster | 62/54.1 |
| 3,105,361 | 10/1963 | Bell et al. | 62/50.1 |
| 3,304,729 | 2/1967 | Chandler et al. | 62/48.3 |
| 3,486,302 | 12/1969 | Paynter | 55/159 |
| 3,854,905 | 12/1974 | Balzer et al. | 55/159 |
| 4,145,892 | 3/1979 | Skakunov et al. | 62/45.1 |
| 4,272,257 | 6/1981 | Ellion et al | 55/38 |
| 4,399,831 | 8/1983 | Robert | 137/154 |
| 4,412,851 | 11/1983 | Laine | 55/160 |
| 4,595,398 | 6/1986 | Orton et al. | 55/182 |
| 5,263,329 | 11/1993 | Grove et al. | 62/50.1 |
| 5,279,323 | 1/1994 | Grove et al. | 137/154 |
| 5,398,515 | 3/1995 | Lak | 62/47.1 |
| 5,613,366 | 3/1997 | Schoenman | 62/45.1 |

OTHER PUBLICATIONS

*Design of Propellant Acquisition Systems for Advanced Cryogenic Space Propulsion Systems*, G.W. Burge et al., AIAA Paper 73–1287, Nov. 1973.

*In–Space Propellant Acquisition With Pleated Screen Tubes*, S. Boraas et al., AIAA Paper 74–1152, Oct. 1974.

*Space Shuttle Reaction Control Subsystem Propellant Acquisition*, D.A. Fester et al., AIAA Paper 74–1106, Oct. 1974.

*Primary Examiner*—William Doerrler

*Attorney, Agent, or Firm*—Alston & Bird LLP

[57] ABSTRACT

There is provided a vessel storing cryogenic fluid having a passive thermodynamic venting system for effectively and reliably transferring heat in a reduced-gravity environment. The storage vessel has a storage tank for holding the cryogenic fluid under pressure. The storage vessel is compartmentalized using a screen trap so that the heat exchanger of the venting system extends through a compartment which includes only the liquid phase of the cryogenic fluid. A screen gallery, screen trap and vane assembly cooperate to separate the gas and the liquid phases of the cryogenic fluid. The thermodynamic venting system includes a throttle device for reducing the temperature of cryogenic fluid. A conduit in contact with heat exchange elements transfers heat from the liquid phase of the cryogenic fluid to a relief valve for venting the heat external of the storage tank.

31 Claims, 7 Drawing Sheets

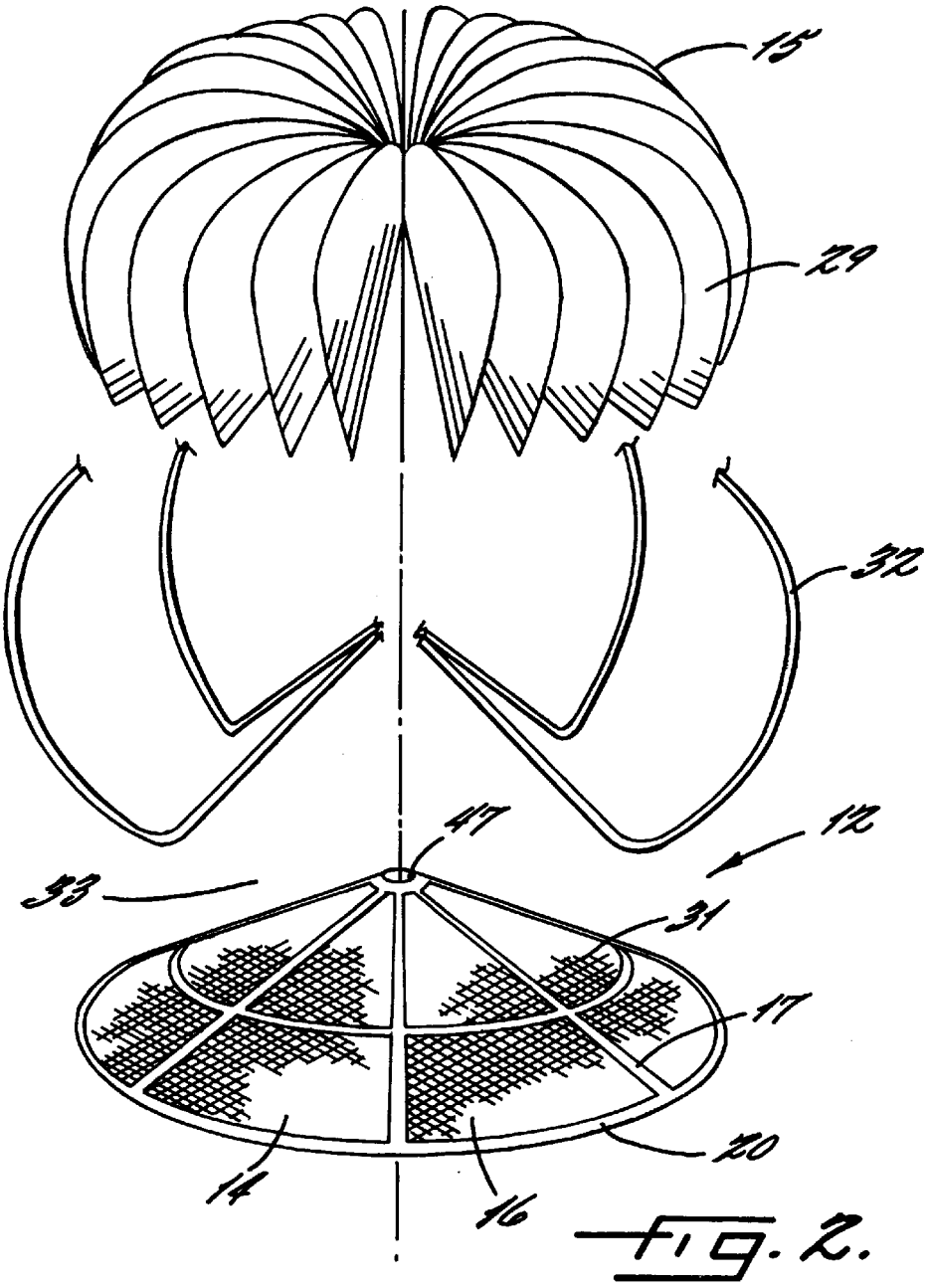
Fig. 2.
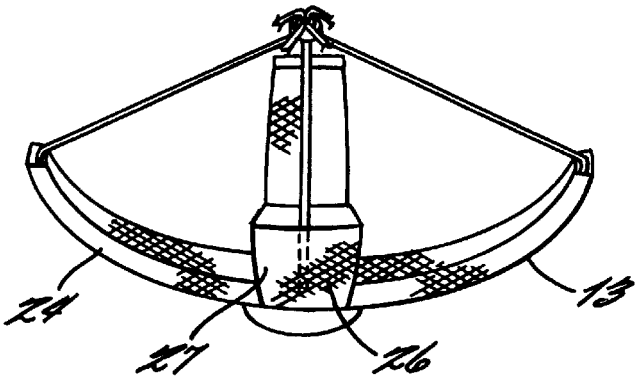

Fig. 3.
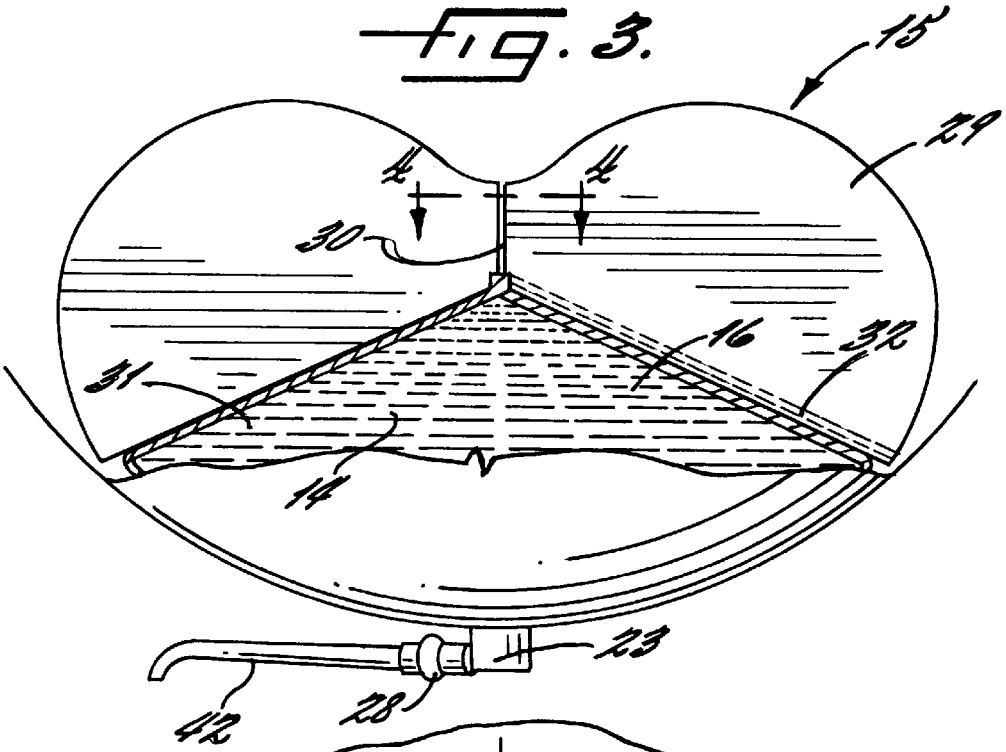
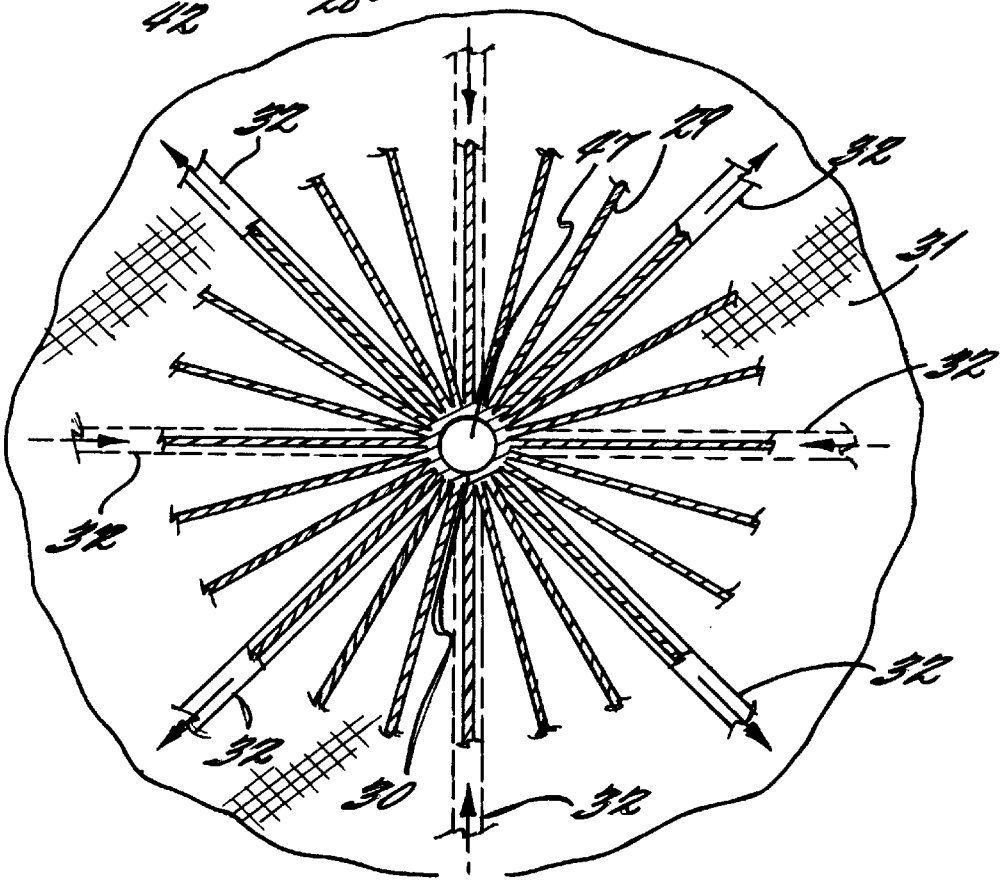
Fig. 4.

ASCENT

COAST

PRE-CIRCULARIZATION

CIRCULARIZATION

POST-CIRCULARIZATION

COAST

TYPICAL RCS FIRE

COAST

GPSS CHARGE

PRE-DEORBIT

DEORBIT

POST DEORBIT

PASSIVE LOW GRAVITY CRYOGENIC STORAGE VESSEL

CROSS REFERENCE TO RELATED APPLICATIONS

This application claims the benefit of U.S. Provisional No. 60/027,624, dated Oct. 4, 1996.

GOVERNMENT RIGHTS

The United States Government may have rights in this invention pursuant to Contract No. NCC8-72 awarded by the National Aeronautics and Space Administration.

FIELD OF THE INVENTION

This invention relates to cryogenic storage tanks, and more particularly, to cryogenic storage tanks for use in reduced-gravity environments.

BACKGROUND OF THE INVENTION

Space vehicles, such as re-useable launch vehicles (RLV), often carry cryogenic fluids, such as liquid hydrogen ($LH_2$) and liquid oxygen ($LO_2$), into outer space for use during a mission, either as a propellant or for power generation. The storage and management of cryogenic liquids in space poses two primary problems to fluid-system designers. Firstly, due to the low-temperatures of liquid hydrogen ($LH_2$) and liquid oxygen ($LO_2$) heat is continuously transferred through the walls of the storage vessel into the fluid, such as during the space vehicle's orbital coast. This heat transfer can cause the liquid cryogen to boil, thus creating a gas phase and increasing the pressure inside the storage vessel. Accordingly, storage vessels are vented when the pressure reaches a predetermined level in order to maintain the structural integrity of the vessel.

The second problem involves the acquisition of a single-phase fluid from the storage vessel upon demand for use by the space vehicle. In an RLV, liquid propellants are required in orbit by the orbital maneuvering system (OMS) engines, and by the gaseous propellant supply system (GPSS) for circularization of the RLV's orbit, RLV orbital maneuvering, DC-power generation and hydraulic operations. It is therefore important to have the ability to withdraw only the liquid phase from the storage vessel on demand until the fluid has been entirely depleted. On Earth, where gravity is significant, the liquid is generally in a known location within the vessel, namely, settled against the vessel's bottom with the gas phase thereabove. In a reduced-gravity environment, however, the absence of a significant gravitational force means that the liquid and gas phases are generally free to move about inside the vessel. In other words, the liquid phase could be "floating" about the vessel distant from the liquid acquisition valves. Accordingly, fluid movement under reduced-gravity conditions hinders acquisition and withdrawal of a stored cryogenic liquid for use by the vehicle.

Such movement can also interfere with the vessel's vent operation. The vent system is most efficient if only the gas phase is vented from the vessel. Expulsion of liquid propellants through a conventional vessel vent system unnecessarily wastes the cryogenic liquid without significantly reducing the pressure inside the storage vessel.

An RLV low-gravity cryogenic propellant storage system is thus expected to supply liquid propellants to OMS engines during orbital burns and supply liquid propellants to the GPSS throughout the mission. The propellant system should also minimize propellant boil-off and venting of the storage vessel so as not to waste propellant and prevent venting of liquid-phase propellants. It is also desirable to minimize and damp sloshing of the propellant during flight.

In seeking better vessels for storing cryogenic fluids in low gravity, several storage tanks have been suggested. One such example of a cryogenic storage tank is disclosed in U.S. Pat. No. 4,412,851 to Laine which discloses a cryostat for cooling instrumentation and the like on a space craft. The cryostat is a closed storage vessel having a tubular phase separator, centrally located within the vessel, for exchanging heat with the cryogenic fluid stored therein. The phase separator consists of single tubular member having an inlet end and an outlet end. In between the inlet end and the outlet end, there is a system of two constriction sections and two obturators for withdrawing cryogenic fluid from inside the vessel in a controlled fashion. A first constriction section cools the cryogenic fluid and then isolates the fluid in a transfer chamber delimited by the obturators to allow for heat exchange between the cryogenic fluid inside the vessel and the fluid inside the transfer chamber. The obturators operate in a cyclic fashion to fill the transfer chamber, and then subsequently, expel gas from inside the chamber through the outlet end of the phase separator. The gas phase and liquid phase of the cryogenic fluid are allowed to circulate freely within the vessel relative to the transfer chamber.

Another example of a cryogenic storage tank is disclosed in U.S. Pat. No. 5,398,515 to Lak which discloses a cryogenic storage vessel having an active circulating heat transfer system for thermally destratifying both the liquid and gaseous cryogenic fluid stored in the vessel through forced convection mixing. The heat transfer system consists of a recirculation pump for circulating cryogenic fluid from inside the vessel through a spray injection system. Additionally, part of the flow from the recirculation pump may be directed through a flow control external expansion orifice for reducing the temperature of the fluid. The fluid is then directed to an internal heat exchanger of concentric tube design having an inner tube containing the spray injection flow and the outer tube containing either a parallel flow or spiral-type heat exchanger. Use of a recirculation pump in combination with a plurality of valves is expensive and creates an active system whereby fluid flow through the heat exchanger is dependent upon the reliability of the pump and valve system. It is desirable to create a passive heat transfer system for cryogenic vessels which is not reliant on an external pump.

Thus, there is a need for an improved cryogenic storage vessel for reduced-gravity environments. Such a storage vessel must be capable of effectively cooling the cryogenic fluid inside the vessel with improved heat transfer and minimal waste and also be capable of acquiring a substantially liquid phase fluid on demand for use by external devices. In addition, such a storage vessel should not be reliant on the use of an external pump and would preferably incorporate a passive heat transfer system.

SUMMARY OF THE INVENTION

The present invention provides these and other objects and advantages and includes a cryogenic storage vessel having a passive thermodynamic venting system for effectively and reliably transferring heat from the liquid phase of the stored cryogenic fluid in a reduced-gravity environment so that the cryogenic liquid may be preserved for later use by an external device.

The vessel includes a storage tank for holding the cryogenic fluid under pressure and a screen trap which extends across the storage tank for dividing the tank. The screen trap creates a liquid phase compartment which is substantially filled with the liquid phase of the cryogenic fluid and a gas phase compartment for constraining the gas phase of the cryogenic fluid. The screen trap defines a plurality of apertures which are sized to prevent the flow of the gas phase of the cryogenic fluid therethrough yet allow the flow of the liquid phase therethrough.

The storage vessel includes a feed valve having an inlet in the liquid phase compartment through which the liquid phase of the cryogenic fluid is withdrawn from the storage tank and provided to the external device. The storage vessel also includes a main vent valve for releasing cryogenic fluid from the interior of the gas phase compartment when the cryogenic fluid exceeds a predetermined maximum pressure.

The passive thermodynamic venting system includes at least one conduit having an inlet in the liquid phase compartment and extending to the relief valve so that pressure within the storage tank causes cryogenic fluid to flow from the liquid phase compartment into the conduit. The conduit has first, second and intermediate heat exchanger portions. At least one throttle is provided adjacent the inlet of the conduit and upstream of the first heat exchanger portion for reducing the pressure and temperature of the cryogenic fluid as the fluid flows therethrough.

The passive thermodynamic venting system may include a plurality of conduits connected to a manifold which is in turn connected to a relief valve. In such an embodiment, the venting system includes a plurality of throttles each of which corresponds to one of the plurality of conduits. Each of the throttles is located adjacent to the inlet of the corresponding conduit.

The first heat exchanger portion extends within the liquid phase compartment and passes reduced temperature cryogenic fluid through the liquid phase compartment so that heat is transferred from the liquid phase to the cryogenic fluid within the first heat exchanger portion. The first heat exchanger portion includes a tube and a convective heat exchange element connected to the outer surface thereof for convective heat transfer with the liquid phase.

The convective heat exchange element forms a passage surrounding the conduit. The liquid phase flows through the passage to reach the inlet of the conduit, which further increases heat exchange. Advantageously, the convective heat exchange element comprises a pleated screen. A substantial portion of the total heat transferred to the venting system occurs in the first heat exchanger portion.

The intermediate heat exchanger portion traverses and is in conductive contact with the screen trap and passes reduced temperature cryogenic fluid adjacent to the screen trap for conductive heat transfer to the conduit. Advantageously, the intermediate heat exchanger portion of the conduit may traverse the side of the screen trap facing the liquid phase compartment and then traverse the side of the screen trap facing the gas phase compartment.

The second heat exchanger portion extends within the gas phase compartment and passes reduced temperature cryogenic fluid through the gas phase compartment so that heat is transferred from the cryogenic fluid in the gas phase compartment to the cryogenic fluid within the second heat exchanger portion. The second heat exchanger portion includes a tube for convective heat transfer with the cryogenic fluid in the gas phase compartment.

The vessel also includes a closed sump in the liquid phase compartment. The inlets of the conduits extend into the closed sump, while the passages of the convective heat exchange element also extend to the closed sump.

A vane assembly may be used advantageously for repelling the gas phase within the gas phase compartment away from the screen trap. The vane assembly is in conductive contact with the screen trap to increase further conductive heat exchange with the intermediate heat exchanger portion of the conduits.

Accordingly, there has been provided a cryogenic storage vessel allowing for the efficient and reliable storage of cryogenic fluid in a reduced-gravity environment. The cryogenic storage vessel provides an effective liquid-phase-acquisition system that cooperates with the passive thermodynamic venting system to preserve the cryogenic fluid for subsequent use by external devices and to provide liquid phase cryogenic fluid on demand.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and which are not necessarily drawn to scale, wherein:

FIG. 2 is an exploded perspective view illustrating liquid-acquisition system and thermodynamic venting system of FIG. 1;

FIG. 3 is a cross section illustrating the thermodynamic venting system and liquid-acquisition system of FIG. 1;

FIG. 4 is a plan view illustrating the thermodynamic venting system and liquid-acquisition system of FIG. 1;

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
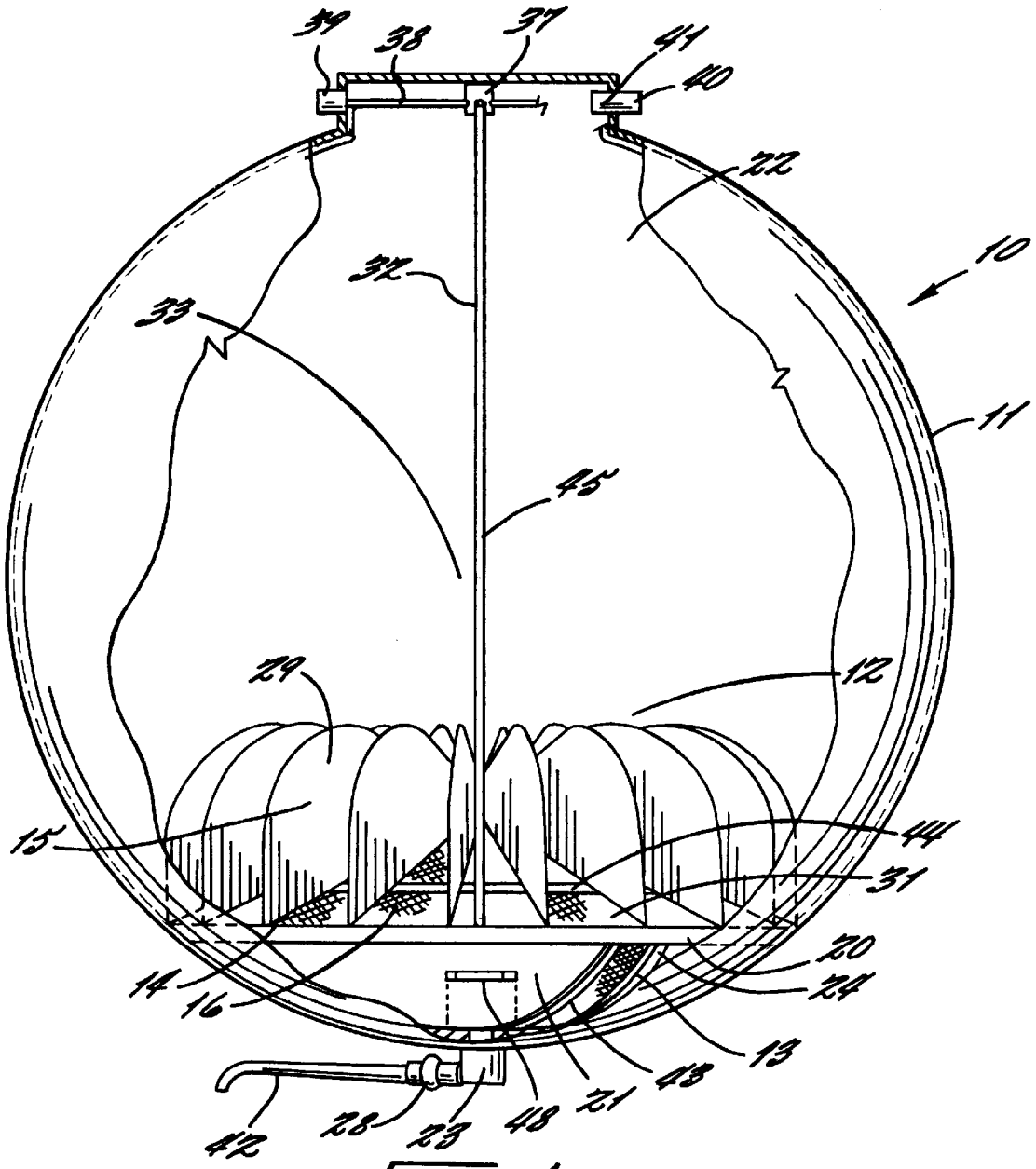
FIG. 1 is a cross section of a cryogenic storage vessel according to the present invention.

Referring now to the drawings and in particular to FIG. 1, there is shown a cross section of the storage vessel 10 constructed according to the present invention. The storage vessel 10 includes a storage tank 11 for holding a cryogenic fluid under pressure in a reduced-gravity environment. Preferably, the storage tank 11 is of a generally spherical shape so as to minimize the internal surface area of the tank and the corresponding heat influx. Deleteriously, heat influx into the storage tank 11 from the ambient environment can result in boiling of the liquid cryogen and the production of excess gas which in turn can threaten the structural integrity of the tank if, unlike the present invention, the tank is not provided with one or more vent valves.

Fluid motion in reduced-gravity involves flow phenomena such as surface tension and buoyancy-induced motion which are normally insignificant in tanks used under normal gravity conditions. In storage vessels stationed on the Earth for example, the only evidence of surface tension is in the liquid meniscus which forms as a result of the adhesion between the molecules of the liquid and the surface of the vessel which is strong enough to overcome the cohesion between the liquid molecules. Similarly, buoyancy-induced fluid motion has a negligible effect on the location of the bulk liquid in normal gravity. In a reduced-gravity environment, however, surface tension and buoyancy can be the dominant forces applied to a confined fluid. The result is a non-intuitive liquid motion with highly-curved free surfaces and heat-transfer-driven motion. The liquid-acquisition system 12 of the present invention uses such flow phenomena to control the location of the liquid and gas phases of the cryogenic fluids.

As can be seen in FIG. 2, the storage vessel 10 includes a liquid-acquisiton system 12 which is formed from a screen gallery 13, a screen trap 14 and a vane assembly 15. The screen trap 14 has a conical geometry and is formed of a pleated screen 16 supported by support members 17 and a support ring 20 which is attached to the storage tank wall. The screen trap 14 extends across the diameter of the storage tank 11 thereby dividing the tank into a liquid phase compartment 21 and a gas phase compartment 22. The use of the terms "gas phase" and "liquid phase" compartments herein is intended to be only an indicator of the desired position of the gas phase component. That is, preferably, the liquid-acquisition system 12 operates to channel only the liquid phase of the cryogenic fluid to the liquid phase compartment 21. Thus, the gas phase compartment may include a liquid phase component, as illustrated in FIGS. 6*a*–6*l*, and, in certain instances, the liquid phase compartment may include a gas phase component. Accordingly, these terms are used as a convenience to describe the intended function of the screen trap 14 of maintaining the gas phase component separate from a liquid sump 23.

Figure 5:
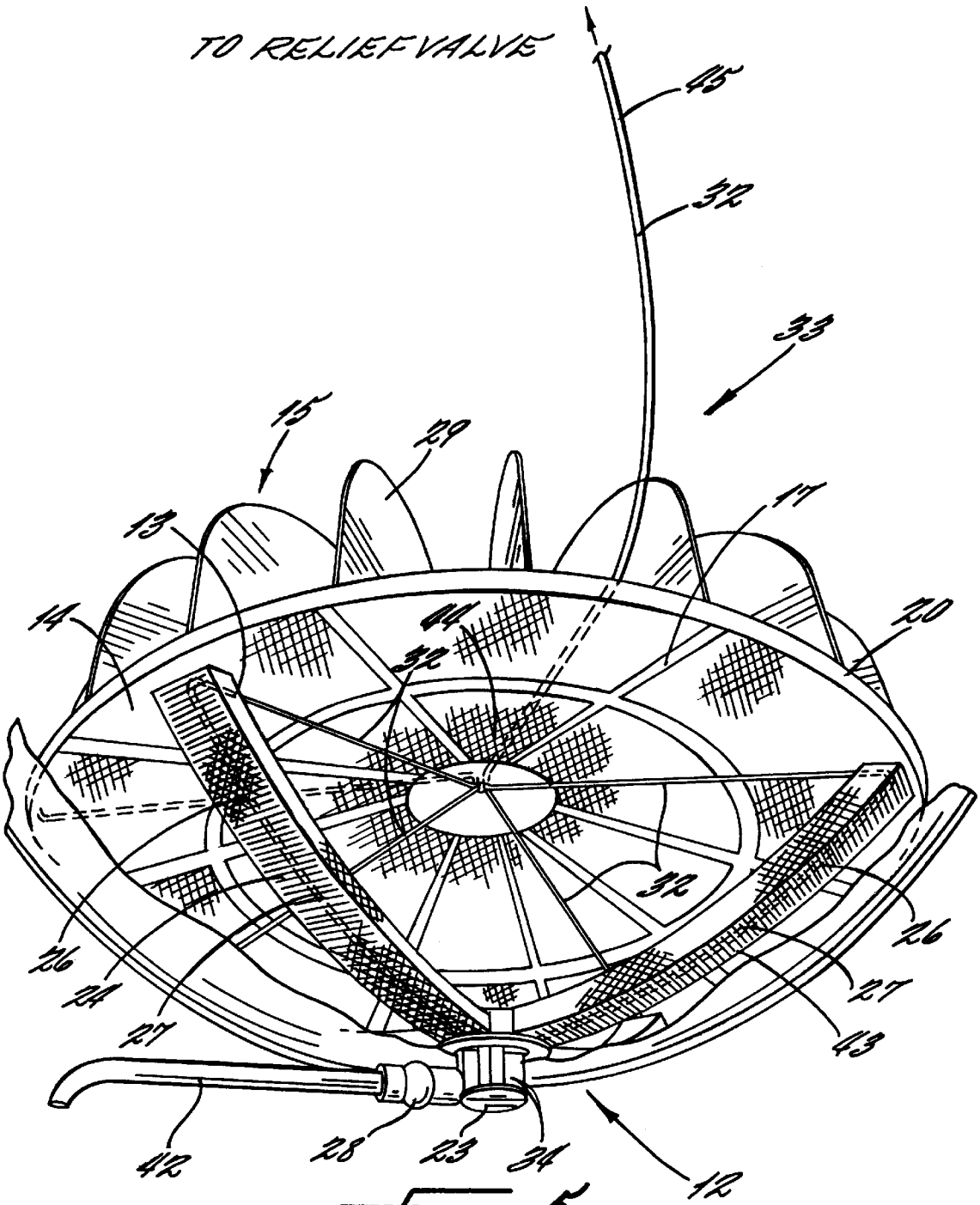
FIG. 5 is a partial perspective view of the thermodynamic venting system and liquid acquisition system of FIG. 1.

As shown in FIG. 5, the screen gallery 13 is attached directly to the closed sump 23 and contains four curved arms 24 formed about a central juncture 25 at the closed sump. The curved shape of the arms 24 corresponds to the spheroidal internal surface of the storage tank 11. As such, the arms 24 fit nearly flush against the inner surface of the storage tank 11. Each arm has a pleated screen 26 on at least the bottom face 27 of the arm through which the cryogenic fluid flows. As shown in FIG. 5, the support ring 20 of the screen trap 14 is supported on the ends of curved arms 24.

The screen trap 14 and screen gallery 13 function based on the capillary characteristics of the screen-fluid system. The passages in the pleated screens 16, 26 are extremely fine. Typically, the screen is formed by a 1400 by 325 filament mesh, which, to the naked eye, appears as a solid sheet. As such, the screens are pleated in a 4-to-1 ratio in order to increase total available surface area or flow-through area and, hence, decrease flow velocities and dynamic losses. In essence, it is difficult for gas to pass through the passages in the screens, however, the screens do allow liquid to flow through. For a given screen-fluid combination a bubble-point pressure differential is defined, which characterizes the tendency for a vapor bubble to be pushed through a screen.

Vapor ingestion through a screen occurs only when a large enough pressure differential exists to overcome the surface-tension forces of the bubbles and force them through the screen flow areas. The liquid phase will thus tend to stay inside a screen enclosure and will preferentially refill the screen gallery 13 or the screen trap 14 from the storage tank 11 when the liquid drains from the storage tank 11 through feed line valve 28, if the following criterion is true:

$$\Delta P_{b\rho} \geqq \Delta P_s + \Delta P_h + \Delta P_d + \Delta P_f$$

where, $_{\Delta}$Pbp is bubble-point pressure difference, $_{\Delta}$Ps is screen flow loss, $_{\Delta}$Ph is hydrostatic pressure difference, $_{\Delta}$Pd is dynamic channel flow loss, and $_{\Delta}$Pf is frictional channel flow loss.

Once the screen flow-area exposed to liquid falls below a minimum value, gas bubbles will be pushed through the screen. By having the screen trap 14 and screen gallery 13 in series, two levels of protection against vapor ingestion are created. The screens on both the screen trap 14 and the screen gallery 13 must break down in order for gas to enter the closed sump 23 region.

Screen-device methods of propellant acquisition have been studied extensively in the past. For additional description of such devices, reference may be had to the technical literature. The reader interested in those details may make reference to the articles by Burge et al, "Design of Propellant Acquisition Systems for Advanced Cryogenic Space Propulsion Systems" AIAA Paper 73–1287, Nov. 1973; Boraas, S., et al, "In-Space Propellant Acquisition with Pleated Screen Tubes," AIAA Paper 74–1152, Oct. 1974; and Blatt, M. H., et al, "Capillary Acquisition Devices for High-Performance Vehicles-Executive Summary," NASA CR-15968, Feb. 1980.

Screen liquid acquisition is currently being used successfully on the Space Shuttle orbital maneuvering system with storable propellants as indicated in the article by Fester, D. A. et al, "Space Shuttle Reaction Control Subsystem Propellant Acquisition", AIAA Paper 74–1106, Oct. 1974. The major benefit of the pleated screen trap 14 and screen gallery 13 design presented is reliable liquid acquisition during adverse gravity levels of up to 0.1 g, which is an order of magnitude greater than that occurring during a typical RCS firing.

As shown in FIGS. 1 and 2, the storage vessel 10 includes a vane assembly 15 containing a plurality of vanes 29 extending radially outward about a central member 30. The bottom of each vane 29 is tapered at an angle to the vertical to correspond to the same cone angle formed by screen trap 14. This allows the vanes 29 to be seated over the outer surface 31 of the screen trap 14, leaving a sufficient clearance between the two in which to fit the conduits 32. As shown in FIG. 5, the conduits 32 may also be placed between a pair of adjacent vanes 29. In a preferred embodiment, the vane assembly 15 contains twenty (20) vanes 29.

The vane assembly 15 provides surface tension repelling of the ullage bubble during orbital coast as well as prevents vortexing of the cryogenic fluid. The required bubble-repelling performance is used to define the size, shape, and number of vanes 29 in the vane assembly 15 in accordance with known principles and formulae.

The maximum distance between the vanes 29 is approximately twelve inches for a typical application. This provides a small enough characteristic length (or bubble diameter) to ensure orbital-coast Bond numbers that are much less than one (1) in all of the flow passages in the bottom 40% of the RLV propellant tanks.

The Bond number, Bo, it is recalled, is defined $$B_o = \frac{g(\rho_l - \rho_g)L^2}{\sigma} = \frac{\text{buoyancy-forces}}{\text{surface-tension-forces}}$$

where, g is net acceleration magnitude; $\rho_l$ is liquid density, $\rho_g$ is gas density; L is characteristic length; and Γ is liquid-gas surface-tension coefficient.

Where Bond numbers are much less than one (1), surface-tension forces are significantly greater than any gravitational force and can be used to position the storage tank ullage bubble. The vane assembly 15 will only work as a bubble-repeller during the low-gravity, approximately $10^{-5}$ g, coast.

During a reaction control system (RCS) firing, the bubble should collapse over the vanes due to the relatively large acceleration imposed by the RCS thrusters (0.001 g). In this situation, the pleated screen gallery 13 and screen trap 14 will nonetheless take over and contain the propellant making it available at the closed sump 23 to the propulsion systems on demand.

With the ullage bubble's tendency to stay in the forward section of the tank, less propellant mass is exposed to the warmer storage tank walls and thus less propellant boil off occurs. This is particularly evident in RLV missions that are longer than 12 hours. Even a short RLV mission is near 24 hours while longer ones may last 7 days. During a short run RLV mission, a relatively small volume of propellant occupies the tank, which is sized for the seven-day mission. Accordingly, most of the liquid is found located in the aft section of the storage tank with ullage bubble covering most of the forward storage tank walls.

Unsuppressed in a low-gravity environment, a liquid tends to cover the storage tank walls with a roughly spherical ullage bubble in the center. This is advantageous in screen-liner-type propellant management systems, such as that found in the Space Shuttle. However, for missions of longer duration, minimization of cryogenic fluid boil-off requires a different approach. As will be discussed below, the screen gallery 13, screen trap 14, and vane assembly 15 combination provides both liquid phase acquisition and reduced boil-off.

Use of surface-tension-vanes for bubble repelling is not a new concept; a similar system was flown successfully on the Viking Orbiter mission with storable propellants.

FIGS. 6A–6M pictorially illustrate the disposition of the liquid volumes in the storage tank, represented by the shaded area, and the ullage bubble represented in white, at various phases in the $LO_2$ system stowed with a vertical take off and vertical landing (VTVL) RLV.

Figure 6A:
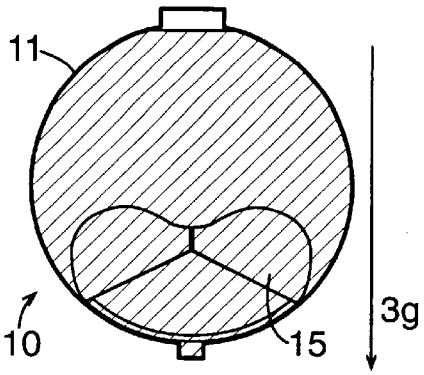
FIGS. 6A–6L are plan views illustrating the location of the cryogenic fluid within the cryogenic storage tank during various phases of an orbital mission.
Figure 6B:
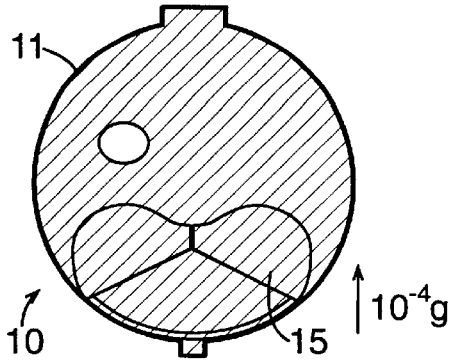

FIG. 6A shows the disposition during ascent. Initially, the storage tank is substantially filled with the liquid phase of the cryogenic fluid. The gravitational force is illustrated pushing down at about 3 g. FIG. 6B shows the longevity coast after main engine cut-off, MECO. Surface tension forces are evident in the relatively spherical ullage bubble.

Figure 6C:
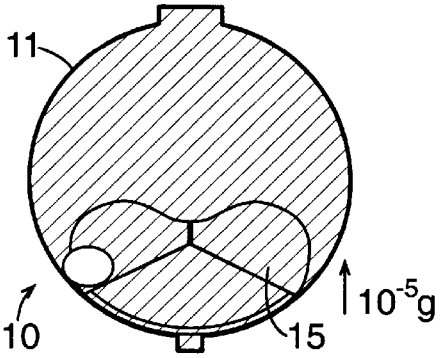
Figure 6D:
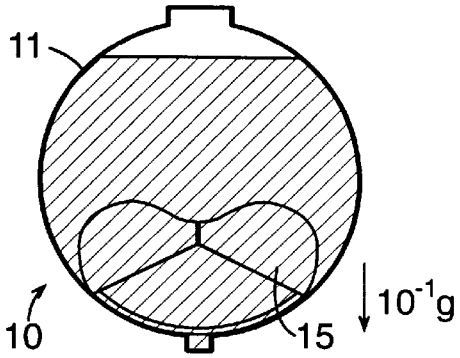

FIG. 6C shows the pre-circularization stage. An atmospheric drag acceleration of $10^{-5}$ g acts in the forward direction. By the time the vehicle is ready to circularize the orbit, the small ullage bubble is settled against the vane assembly 15 or possibly the screen trap 14. FIG. 6D shows circularization. Some liquid has been withdrawn from the storage tank through feed line valve 28 for use. During circularization an axial acceleration near $10^{-5}$ g is applied to the vehicle. This settles the cryogenic fluid with a nearly flat free surface. Surface tension forces are not significant compared to buoyancy, so there is little curvature in the level of the liquid phase.

Figure 6E:
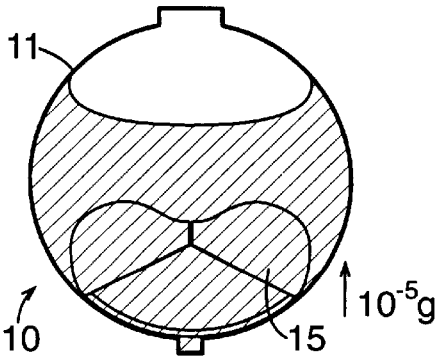
Figure 6F:
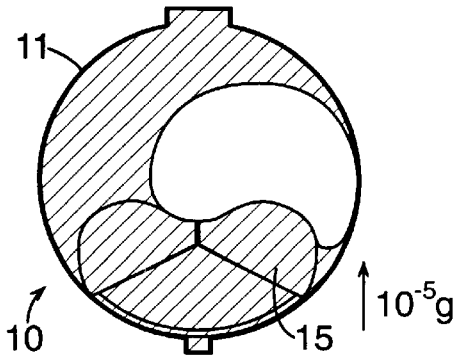

Post circularization is represented in FIG. 6E. The liquid phase is again subjected to a drag acceleration near $10^{-5}$ g. Accordingly, the free surface of the liquid phase begins to curve due to the force of surface tension. FIG. 6F shows the orbital or second coast. Drag acceleration on the order of $10^{-5}$ g in the storage tank's forward direction continues. Once coasting in orbit for a significant period of time, the ullage bubble settles against the vane assembly 15, but is prevented from passing through to the closed sump 23. The closed sump 23 remains completely covered with the liquid phase of the cryogenic fluid.

Figure 6G:
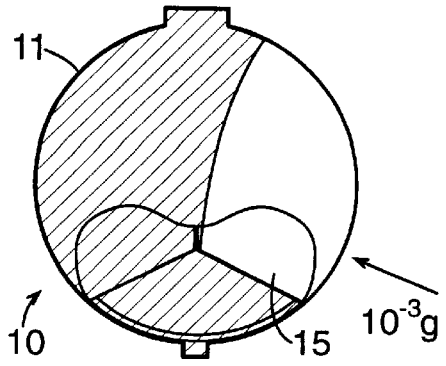

During a typical RCS firing, as represented in FIG. 6G, the vane assembly 15 breaks down due to the relatively large gravitational field produced, on the order of $10^{-3}$ g in a sideways direction to the storage tank. The screen gallery 13 and screen trap 14, however, contain cryogenic fluid in the liquid phase and attract the liquid phase to the closed sump 23 preferentially to gas while draining.

Figure 6H:
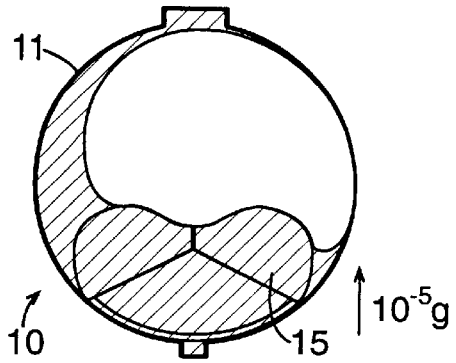
Figure 6I:
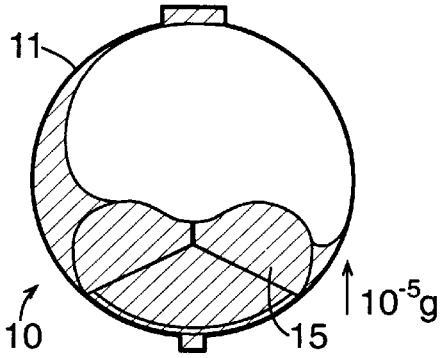

During the third orbital coast following an RCS burn, represented in FIG. 6H, the ullage bubble begins to position itself above the vane assembly 15. The GPSS charge is represented in FIG. 6I. Before the descent sequence is initiated, the gas accumulators for the GPSS are charged to maximum capacity. The stored gas provides all RCS, ACS, APU, fuel cell propellant during descent. The volume of propellant has decreased from the volume shown in FIG. 6H due to on-orbit boil-off and maneuvering.

Figure 6J:
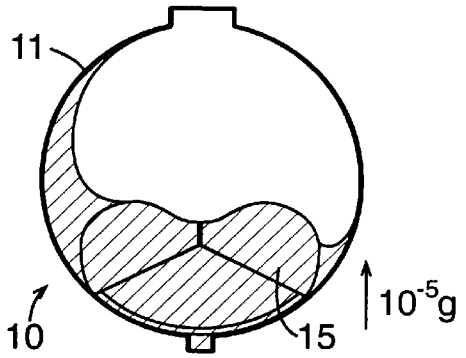
Figure 6K:
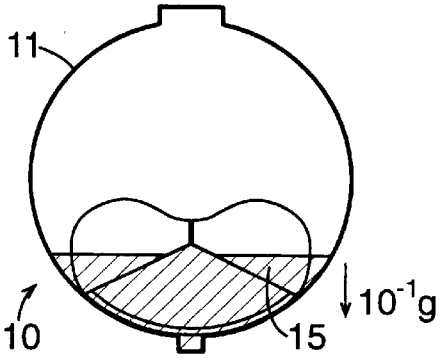
Figure 6L:
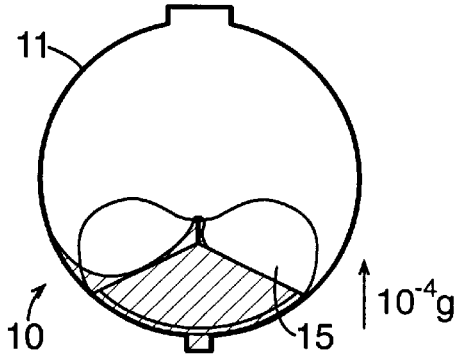

In FIG. 6J the space vehicle is preparing for de-orbiting. Prior to the de-orbit burn of propellant, the ullage bubble is positioned above the vane assembly 15 with the screen gallery 13 and screen trap 14 trap remaining full of liquid. The de-orbit burn occurs, FIG. 6K, and the tank is subjected to a $10^{-1}$ g force in the storage tank's aft direction. Axial acceleration settles the liquid cryogenic fluid in the aft region of the storage tank 11. Post de-orbit following the de-orbit burn, as represented in FIG. 6L, the vehicle again is in a low gravity drag, approximately $10^{-4}$ g. The liquid phase is contained within the screen gallery 13 and screen trap but the vane assembly 15 begin to break down as the vehicle flies into increasingly thicker atmosphere. Although additional propellants in other tanks continue in the final steps of the deorbiting and landing procedure, they are not illustrated as the foregoing figures adequately illustrates the function of the tank elements.

As shown in FIG. 1, the storage vessel 10 also includes a passive thermodynamic vent system or TVS 33, which absorbs heat from both the gas and liquid phases of the cryogenic fluid and vents the heat into the ambient environment external to the storage tank 11. The TVS thus controls the pressure inside the storage tank 11 through control of the temperature of the cryogenic fluid. As can be seen more clearly through FIGS. 5 and 7, the TVS includes four throttling devices 34, conduits 32, a screen gallery 13, a screen trap 14, a vane assembly 15, a manifold 37, manifold line 38, a relief valve 39, and a control system (not shown). The foregoing elements are preferably of a shape or geometry that permits them to fit together and generally conform to the inside surfaces of the storage tank 11.

The four throttling devices 34, which are advantageously Joule-Thompson devices, are located in the closed sump 23 in the liquid phase compartment 21. The throttling devices 34 may be orifices or viscojets, both of which are well known in the art. In the TVS 33, a one phase (and sometimes two phase) fluid is drawn into the Joule-Thompson throttling devices 34 and expanded to a lower pressure. For cryogenic propellants, which all have positive Joule-Thompson coefficients, the decrease in pressure also decreases the temperature. Thus, the relatively cooler two-phase vent fluid flows through the conduits 32 removing heat from the bulk propellant mass in the tank and finally exits the vehicle via relief valve 39 with a quality near 0.9. The net effect is that the propellant and ullage bubble are cooled, which, in turn, increases the densities and, advantageously, also lowers tank pressure. Also, the vented fluid is almost always vented in the gaseous state. The throttling devices 34 connect to four respective conduits 32.

Figure 8:
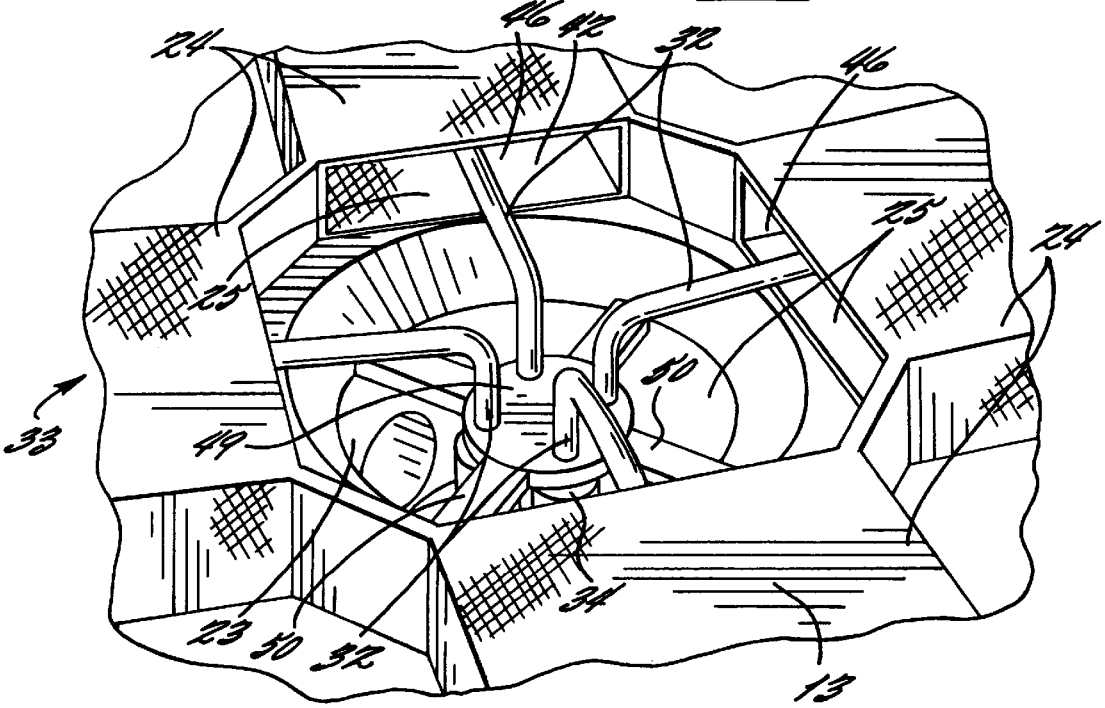
FIG. 8 is a partial perspective view illustrating the sump portion of the tank of FIG. 1 as viewed looking down into the sump with a top plate of the screen gallery removed.

As shown in FIGS. 5 and 8, the four conduits 32 form a first heat exchanger portion 43, a second heat exchanger portion 45, and an intermediate heat exchanger portion 44. The flow paths of the respective heat exchanger portions are as follows. The first heat exchanger portion 43 surrounds the liquid cryogen in the closed sump 23 and are attached to the inside top of the arms 24 of the screen gallery 13. Each arm 24 forms a convective heat exchanger element. The term "convective" as used herein is intended to denote heat transfer which is conventional in connection with liquids and gases. However, as is appreciated by one of ordinary skill in the art, with objects in contact with fluids which have very little internal movement, such as is common in low gravity situations, conduction may actually be the more dominant heat transfer mode. The conduits 32 of the first heat exchanger portion 43 are in metal to metal contact with the arms 24 of the screen gallery 13 which thereby provides greater heat exchanger surface area.

Advantageously, the additional heat exchanger surface area is provided in the liquid phase compartment 21 which is substantially filled with liquid phase cryogenic fluid. The reduced temperature fluid in the conduits 32, having just left the throttling devices 34, will absorb a substantial amount of heat from the bulk liquid in the area of the first heat exchanger portion 43. The additional surface area also helps prevent local freezing of fluid adjacent to the conduits 32 due to lower heat fluxes than those associated with a tube-only heat exchanger.

As shown in FIGS. 3 and 4, the intermediate heat exchanger portion 44 is formed when the conduits 32 leave the arms 24 of the screen gallery 13 and contact the screen trap 14. The conduits 32 extend along the inside surface of the screen trap 14 and through the central opening 47 at the apex of the screen trap 14. After exiting the central opening 47 the conduits 32 in the intermediate heat exchanger portion 44 extend back down the outside surface of the screen trap 14 to the tank wall.

Figure 7:
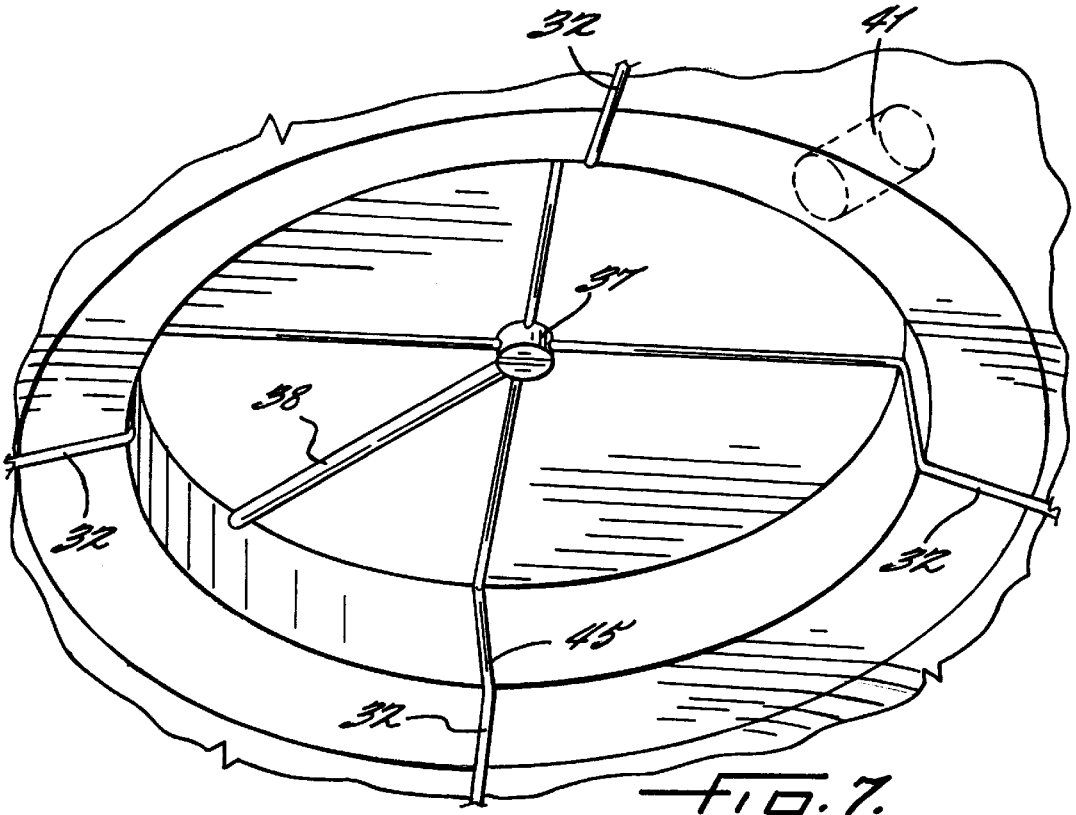
FIG. 7 is a partial perspective view of the manifold, relief valve, main vent line and main vent valve of FIG. 1.

The second heat exchanger portion 45 begins at the tank wall and extends to the manifold 37 as shown in FIG. 7. At the manifold 37 the conduits 32 deliver the warmed fluid, which at this point should be almost completely gaseous, to the manifold line 38. The warm gas is ejected from the storage tank 11 at relief valve 39.

Relief valve 39 is located outside of the storage tank 11. That valve serves as the primary means of controlling the pressure of the storage tank 11 through the TVS 33. A second larger, main vent valve 40 is included and serves as a back-up in case the TVS cannot reduce the pressure quickly enough and for venting during tank fill. The main vent valve 40 connects to a main vent line 19. A storage tank feed line valve 28 is located at the closed sump 23, where it is connected to a feed line 42 for providing the liquid phase cryogen fluid to an external device, such as a rocket motor.

The relief valve 39 is electrically controlled. In use, the electrical circuits for operating the relief valve 39 are connected to external control equipment. The control equipment determines when the internal tank pressure, monitored by a sensor, not illustrated, reaches a predetermined maximum limit and then opens the valve to allow the gases to boil off, decrease in temperature, cool the bulk propellant, and thus reduce the internal pressure. Likewise the feed line valve 28 is electrically controlled via electrical circuit by external equipment that determines when cryogenic fluid is to be pumped from the storage tank 11. A pressurant supply system, not illustrated, maintains tank pressure as liquid is removed. The foregoing valves are the only two active elements in the system. The remaining elements function passively, as hereinafter discussed.

To better illustrate some of the mechanical details reference is made to FIG. 8, which illustrates a close-up enlarged view of the closed sump 23 region located on the bottom side of the storage tank 11 of FIG. 1. FIG. 8 is a view looking down into the closed sump 23, with the closed sump cover 48 removed. The four arms 24 of the screen gallery 13 are shown, symmetrically arranged about a central juncture 25 with some of the pleats of the material forming the arm 24 underlying the bottom surface exposed. The feed line 42 contains an entrance into that central juncture 25. The conduits 32 are symmetrically spaced about the central juncture 25. The conduits 32 extend along the bottom of the storage tank 11 and are bent at a right angle with an end extending downward into the central juncture 25. The ends of those TVS lines are supported by the central disk member 49, which in turn is attached to and supported by the passage walls by the four support beams 50. Each of the conduits 32 communicates with a respective throttling device 34 mounted beneath the central disk member 49.

As illustrated in FIG. 5, the manifold 37 which merges the flows from the four conduits 32, is formed in a disc shaped member located at the upper end of the storage tank 11. The main vent line 41 extends through an internal passage in the disk. The manifold line 38 to the tank's exterior is formed by another opening. As illustrated, the upper ends of the conduits 32 in the second heat exchanger portion follow a route that traverses a vertical extent along the side walls of the recess 51 and then turn horizontally to the manifold 37 at the center of the recess 51.

All of the foregoing elements are formed of a metal with high thermal conductivity, except the storage tank 11, which is preferably formed of a graphite epoxy composite or aluminum metal. Storage tank 11 is constructed using conventional techniques, typically welding or bonding spheroidal curved panels into a sphere. During its construction (when the sphere is not yet completely formed) and the inside is accessible, the internal components are inserted within the partially formed sphere and fixed in place, to the extent practicable. Afterward, the sphere is completed. Additional construction detail for the internal components may be completed afterward, such as welding the top end of the conduit 32 to the inside wall of the storage tank 11. The top cover containing the relief valve 39 may be removed and a person may fit or reach through the opening. Alternatively, the tank may be completely fabricated and the internal components may be built thereafter directly within the cavity.

The foregoing passive TVS 33 should have much lower flow-rates than conventional vent systems and thus is generally only used to maintain tank pressure after tank fill. The main vent line 41 and main vent valve 40, which may be conventional high-flow-rate vents is are used for the fill process and as a back-up vent system.

In the drawings and the specifications, there has been set forth preferred embodiments of the invention and, although specific terms are employed, the terms are used in a generic and descriptive sense only and not for purpose of limitation, the scope of the invention being set forth in the following claims.

That which is claimed:

1. A vessel for storing cryogenic fluid in a reduced-gravity environment, wherein the fluid includes a liquid phase which is provided to an external device and a gas phase, said vessel comprising:

a storage tank for holding the cryogenic fluid under pressure;

a screen trap defining a plurality of apertures which are sized to prevent the flow of the gas phase therethrough yet allow the flow of the liquid phase therethrough, said screen trap extending across said storage tank for dividing said tank and creating a liquid phase compartment which is substantially filled with the liquid phase of the cryogenic fluid;

a feed valve having an inlet in said liquid phase compartment through which the liquid phase of the cryogenic fluid is withdrawn from said storage tank and provided to the external device;

a relief valve for releasing substantially gaseous cryogenic fluid from the interior of said storage tank when said cryogenic fluid exceeds a predetermined maximum pressure;

at least one conduit having an inlet in said liquid phase compartment and extending to said relief valve so that pressure within said storage tank causes cryogenic fluid to flow from said liquid phase compartment into said conduit, said conduit having a heat exchanger portion extending within said liquid phase compartment; and at least one throttle adjacent said inlet of said conduit and upstream of said heat exchanger portion for reducing the pressure and temperature of the cryogenic fluid as the fluid flows therethrough such that said heat exchanger portion passes reduced temperature cryogenic fluid through said liquid phase compartment and heat is transferred from the liquid phase to the cryogenic fluid within said heat exchanger portion.

2. A vessel as defined in claim 1, wherein said heat exchanger portion of said conduit comprises a tube and a convective heat exchange element connected to the outer surface thereof for convective heat transfer with the liquid phase.

3. A vessel as defined in claim 2, wherein said convective heat exchange element forms a passage surrounding said conduit through which the liquid phase flows to reach said inlet of said conduit.

4. A vessel as defined in claim 3, further comprising a closed sump, and wherein said inlet of said conduit extends into said closed sump and said passage of said convective heat exchange element extends to said closed sump.

5. A vessel as defined in claim 2, wherein said convective heat exchange element comprises a screen.

6. A vessel as defined in claim 5, wherein said screen is pleated.

7. A vessel as defined in claim 1, further comprising:

a manifold connected to said relief valve;

a plurality of conduits, each of said conduits having an inlet in said liquid phase compartment and extending to said manifold so that pressure within said storage tank causes cryogenic fluid to flow from said liquid phase compartment into each of said plurality of conduits, each of said conduits having a heat exchanger portion extending within said liquid phase compartment; and a plurality of throttles corresponding to said plurality of conduits, each of said throttles being adjacent to said inlet of each of said corresponding conduits.

8. A vessel for storing cryogenic fluid in a reduced-gravity environment, wherein the fluid includes a liquid phase which is provided to an external device and a gas phase, said vessel comprising:

a storage tank for holding the cryogenic fluid under pressure;

a screen trap defining a plurality of apertures which are sized to prevent the flow of the gas phase therethrough yet allow the flow of the liquid phase therethrough, said screen trap extending across said storage tank for dividing said tank and creating a liquid phase compartment which is substantially filled with the liquid phase of the cryogenic fluid and a gas phase compartment for confining gaseous cryogenic fluid;

a feed valve having an inlet in said liquid phase compartment through which the liquid phase of the cryogenic fluid is withdrawn from said storage tank and provided to the external device;

a relief valve for releasing substantially gaseous cryogenic fluid from the interior of said storage tank when said cryogenic fluid exceeds a predetermined maximum pressure;

at least one conduit having an inlet in said liquid phase compartment and extending to said relief valve so that pressure within said storage tank causes cryogenic fluid to flow from said liquid phase compartment into said conduit, said conduit having a first heat exchanger portion extending within said liquid phase compartment and a second heat exchanger portion extending within said gas phase compartment; and at least one throttle adjacent said inlet of said conduit and upstream of said first heat exchanger portion for reducing the pressure and temperature of the cryogenic fluid as the fluid flows therethrough such that said first heat exchanger portion passes reduced temperature cryogenic fluid through said liquid phase compartment and heat is transferred from the liquid phase to the cryogenic fluid within said first heat exchanger portion, and such that said second heat exchanger portion passes reduced temperature cryogenic fluid through said gas phase compartment and heat is transferred from the cryogenic fluid in the gas phase compartment to the cryogenic fluid within said second heat exchanger portion.

9. A vessel as defined in claim 8, further comprising a vane assembly for repelling the gas phase within said gas phase compartment away from said screen trap.

10. A vessel as defined in claim 8, wherein said first heat exchanger portion of said conduit comprises a tube and a convective heat exchange element connected to the outer surface thereof for convective heat transfer with the liquid phase.

11. A vessel as defined in claim 8, wherein said second heat exchanger portion comprises a tube.

12. A vessel as defined in claim 10, wherein said convective heat exchange element forms a passage surrounding said conduit through which the liquid phase flows to reach said inlet of said conduit.

13. A vessel as defined in claim 12, further comprising a closed sump, and wherein said inlet of said conduit extends into said closed sump, and said passage of said convective heat exchange element extends to said closed sump.

14. A vessel as defined in claim 10, wherein said convective heat exchange element comprises a screen.

15. A vessel as defined in claim 14, wherein said screen is pleated.

16. A vessel as defined in claim 8, further comprising:

a manifold connected to said relief valve;

a plurality of conduits, each of said conduits having an inlet in said liquid phase compartment and extending to said manifold so that pressure within said storage tank causes cryogenic fluid to flow from said liquid phase compartment into each of said plurality of conduits, each of said conduits having a first heat exchanger portion extending within said liquid phase compartment and a second heat exchanger portion extending within said gas phase compartment and being connected to said manifold; and a plurality of throttles corresponding to said plurality of conduits, each of said throttles being adjacent to said inlet of each of said corresponding conduits.

17. A vessel as defined in claim 16, further comprising a main vent valve for releasing cryogenic fluid from the interior of said gas phase compartment when said cryogenic fluid exceeds a predetermined maximum pressure.

18. A vessel for storing cryogenic fluid in a reduced-gravity environment, wherein the fluid includes a liquid phase which is provided to an external device and a gas phase, said vessel comprising:

a storage tank for holding the cryogenic fluid under pressure;

a screen trap defining a plurality of apertures which are sized to prevent the flow of the gas phase therethrough yet allow the flow of the liquid phase therethrough, said screen trap extending across said storage tank for dividing said tank and creating a liquid phase compartment which is substantially filled with the liquid phase of the cryogenic fluid and a gas phase compartment for confining gaseous cryogenic fluid;

a feed valve having an inlet in said liquid phase compartment through which the liquid phase of the cryogenic fluid is withdrawn from said storage tank and provided to the external device;

a relief valve for releasing substantially gaseous cryogenic fluid from the interior of said storage tank when said cryogenic fluid exceeds a predetermined maximum pressure;

at least one conduit having an inlet in said liquid phase compartment and extending to said relief valve so that pressure within said storage tank causes cryogenic fluid to flow from the liquid phase compartment into said conduit, said conduit having first, second and intermediate heat exchanger portions, said first heat exchanger portion extending within said liquid phase compartment, said intermediate heat exchanger portion traversing and being in conductive contact with said screen trap, and said second heat exchanger portion extending within said gas phase compartment; and at least one throttle adjacent said inlet of said conduit and upstream of said first heat exchanger portion for reducing the pressure and temperature of the cryogenic fluid as the fluid flows therethrough such that said first heat exchanger portion passes reduced temperature cryogenic fluid through said liquid phase compartment and heat is transferred from the liquid phase to the cryogenic fluid within said first heat exchanger portion, and such that said intermediate heat exchanger portion passes reduced temperature cryogenic fluid adjacent to said screen trap for conductive heat transfer to said conduit, and such that said second heat exchanger portion passes reduced temperature cryogenic fluid through said gas phase compartment and heat is transferred from the cryogenic fluid in said gas phase compartment to the cryogenic fluid within said second heat exchanger portion.

19. A vessel as defined in claim 18, further comprising a vane assembly for repelling the gas phase within said gas phase compartment away from said screen trap, said vane assembly being in conductive contact with said screen trap.

20. A vessel as defined in claim 18, wherein said first heat exchanger portion of said conduit comprises a tube and a convective heat exchange element connected to the outer surface thereof for convective heat transfer with the liquid phase.

21. A vessel as defined in claim 18, wherein said second heat exchanger portion of said conduit comprises a tube.

22. A vessel as defined in claim 18, wherein said intermediate heat exchanger portion of said conduit traverses the side of said screen trap facing said liquid phase compartment and then traverses the side of said screen trap facing said gas phase compartment.

23. A vessel as defined in claim 20, wherein said convective heat exchange element forms a passage surrounding said conduit through which the liquid phase flows to reach said inlet of said conduit.

24. A vessel as defined in claim 20, further comprising a closed sump, and wherein said inlet of said conduit extends into said closed sump and said passage of said convective heat exchange element extends to said closed sump.

25. A vessel as defined in claim 20, wherein said convective heat exchange element comprises a screen.

26. A vessel as defined in claim 25, wherein said screen is pleated.

27. A vessel as defined in claim 18, further comprising:

a manifold connected to said relief valve;

a plurality of conduits, each of said conduits having an inlet in said liquid phase compartment and extending to said manifold so that pressure within said storage tank causes cryogenic fluid to flow from said liquid phase compartment into each of said plurality of conduits, each of said conduits having first, second and intermediate heat exchanger portions, said first heat exchanger portion extending within said liquid phase compartment, said intermediate heat exchanger portion traversing and being in conductive contact with said screen trap, and said second heat exchanger portion extending within said gas phase compartment and being connected to said manifold; and a plurality of throttles corresponding to said plurality of conduits, each of said throttles being adjacent to said inlet of each of said corresponding conduits.

28. A vessel as defined in claim 27, further comprising a main vent valve for releasing cryogenic fluid from the interior of said gas phase compartment when said cryogenic fluid exceeds a predetermined maximum pressure.

29. A vessel as defined in claim 1 wherein said storage tank is spherical.

30. A vessel as defined in claim 8, wherein said storage tank is spherical.

31. A vessel as defined in claim 18 wherein said storage tank is spherical.

* * * * *